US007933538B2

(12) United States Patent
Aoki et al.

(10) Patent No.: US 7,933,538 B2
(45) Date of Patent: Apr. 26, 2011

(54) COLOR ELECTROPHOTOGRAPHIC IMAGE FORMING APPARATUS INCLUDING A ROTARY DRIVE TRANSMISSION MECHANISM

(75) Inventors: Daisuke Aoki, Numazu (JP); Yasuhiro Fukase, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 341 days.

(21) Appl. No.: 12/114,311

(22) Filed: May 2, 2008

(65) Prior Publication Data

US 2008/0286011 A1 Nov. 20, 2008

(30) Foreign Application Priority Data

May 15, 2007 (JP) ..... 2007-128983
Apr. 23, 2008 (JP) ..... 2008-112000

(51) Int. Cl.
*G03G 15/01* (2006.01)

(52) U.S. Cl. ..... 399/227

(58) Field of Classification Search ..... 399/227, 399/119, 167
See application file for complete search history.

(56) References Cited

U.S. PATENT DOCUMENTS

| | | | | |
|---|---|---|---|---|
| 7,317,888 | B2 | 1/2008 | Obuchi et al. | |
| 2003/0016965 | A1* | 1/2003 | Matsumoto | 399/167 |
| 2004/0061278 | A1* | 4/2004 | Nakano | 271/114 |
| 2005/0191091 | A1 | 9/2005 | Isobe et al. | |
| 2007/0092297 | A1* | 4/2007 | Shimura et al. | 399/167 |
| 2007/0177901 | A1 | 8/2007 | Kawashima | |
| 2007/0212112 | A1* | 9/2007 | Kadota et al. | 399/227 |

FOREIGN PATENT DOCUMENTS

| | | |
|---|---|---|
| JP | 2004-145272 A | 5/2004 |
| JP | 2005-227719 | 8/2005 |
| JP | 2007-199585 A | 8/2007 |

OTHER PUBLICATIONS

Notification of the First Office Action dated Aug. 7, 2009 in Chinese Application No. 200810099241.0, and an English-language translation therefor.

Japanese Office Action dated Nov. 11, 2008 in Japanese Application No. 2008-112000, and an English-language translation thereof.

* cited by examiner

*Primary Examiner* — David M Gray
*Assistant Examiner* — Rodney Bonnette
(74) *Attorney, Agent, or Firm* — Fitzpatrick, Cella, Harper & Scinto

(57) ABSTRACT

A color electrophotographic image forming apparatus includes a rotary to support and move developing devices to a development position without an independent driving motor for rotating the rotary. A number V of developing devices supported by the rotary are sequentially moved to and stopped at the development position in which the developing device faces a photosensitive drum. A drive transmission mechanism is provided in which each time one of a number M of claw portions of a trigger cam is disengaged from and engaged with a solenoid, the trigger cam makes a 1/M revolution, and once every 1/M revolution of the trigger cam, a driving force is transmitted to a rotary gear from a rotary drive gear which is rotated integrally with the trigger cam so that the rotary is stopped after being rotated by an angle W which is an aliquot part of (360°/N).

2 Claims, 8 Drawing Sheets

COLOR ELECTROPHOTOGRAPHIC IMAGE FORMING APPARATUS INCLUDING A ROTARY DRIVE TRANSMISSION MECHANISM

BACKGROUND OF THE INVENTION

1. Field of the Invention

The present invention relates to a color electrophotographic image forming apparatus which uses a rotatable rotary supporting member (rotary) which supports a plurality of developing devices.

2. Description of the Related Art

Conventionally, there is known a color electrophotographic image forming apparatus which uses a rotatable rotary supporting member (rotary) which supports a plurality of developing devices. In the color electrophotographic image forming apparatus, there is known a construction in which a pulse motor is independently used as a motor for rotating the rotary supporting member (refer to Japanese Patent Application Laid-Open No. 2005-227719). The pulse motor is engaged with a gear of a large-diameter mounted to the rotary supporting member via multiple gears. By controlling the rotation of the pulse motor, the developing devices supported by the rotary supporting member are positively moved to the development position in which each of the developing devices faces the photosensitive drum.

As described above, in the conventional image forming apparatus, the stop position of the rotary supporting member is controlled by controlling a rotating speed of the pulse motor which can be controlled in its rotating speed. In addition, the pulse motor and the brushless motor which can be controlled in its rotating speed are expensive and large in size, thereby causing increases in cost and space of the apparatus.

SUMMARY OF THE INVENTION

An object of the present invention is to provide a color electrophotographic image forming apparatus which can be obtained at lower cost, and which exhibits an improved space efficiency as compared with a case of using a pulse motor or a brushless motor which can be controlled in its rotating speed.

Another object of the present invention is to provide a color electrophotographic image forming apparatus in which each of the developing devices supported by the rotary supporting member can be positively moved to the development position without installing a motor dedicated to rotating the rotary supporting member.

Still another object of the present invention is to provide a color electrophotographic image forming apparatus in which a member to which a rotation force is transmitted (conveyor roller, fixing device, and transfer belt, for example) can be rotated using the rotation force of the motor for rotating the rotary supporting member.

Yet another object of the present invention is to provide a color electrophotographic image forming apparatus which can be downsized and produced at lower cost as compared with the case of using a pulse motor or a brushless motor, which can be controlled in its rotating speed.

In order to achieve the above-mentioned objects, a representative construction of the present invention is a color electrophotographic image forming apparatus for forming an image on a recording medium, including:

an electrophotographic photosensitive member;

a rotatable rotary supporting member which supports a plurality of developing devices for developing an electrostatic latent image formed on the electrophotographic photosensitive member;

a motor;

a rotation force transmission unit which transmits a rotation force from the motor to the rotary supporting member, the rotation force transmission unit assuming a stop state in which reception of transmission of the rotation force from the motor is stopped and an operation state in which transmission of the rotation force from the motor is received, wherein in the operation state, the rotation force transmission unit receives the rotation force from the motor to rotate the rotary supporting member to sequentially move each of the plurality of developing devices to a development position in which the electrostatic latent image is developed.

According to the present invention, there can be provided a color electrophotographic image forming apparatus which is provided at lower cost and exhibits improved space efficiency as compared with the case of using a pulse motor or a brushless motor, which can be controlled in its rotating speed.

Further, according to the present invention, there can be provided a color electrophotographic image forming apparatus in which each of the developing devices supported by the rotary supporting member can be positively moved to the development position even without a motor dedicated to rotating the rotary supporting member.

Still further, according to the present invention, there can be provided a color electrophotographic image forming apparatus in which a member to which a rotation force is transmitted (conveyor roller, fixing device, and transfer belt, for example) can be rotated by the rotation force of the motor for rotating the rotary supporting member.

Yet further, according to the present invention, there can be provided a color electrophotographic image forming apparatus which can be downsized and produced at lower cost as compared with the case of using a pulse motor or a brushless motor.

Further features of the present invention will become apparent from the following description of exemplary embodiments with reference to the attached drawings.

DESCRIPTION OF THE EMBODIMENTS

Hereinafter, with reference to the drawings, preferred embodiments of the present invention are described. Note that, dimensions, materials, configurations, and relative arrangements of the components described in the following embodiments may be appropriately modified in accordance with various conditions and the construction of the apparatus to which the present invention is applied. Therefore, the following embodiments are not construed to limit the scope thereof unless specific descriptions thereof are made.

Embodiment 1

Figure 1:
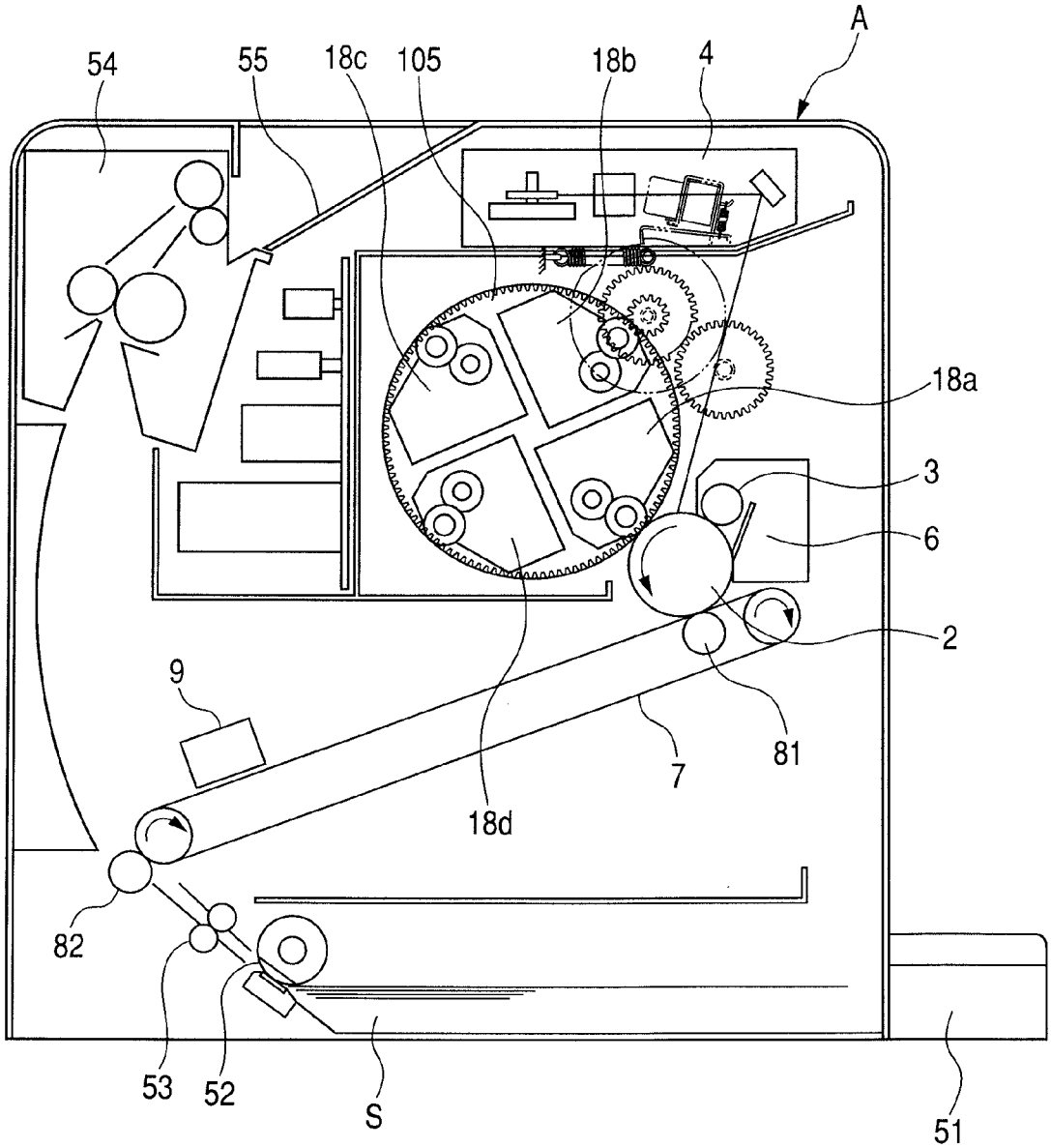
FIG. 1 is a sectional view illustrating a construction of a laser beam printer as an example of an electrophotographic image forming apparatus of the present invention.

A color electrophotographic image forming apparatus according to Embodiment 1 is described. In this case, a color laser beam printer including four developing devices is exemplified as the color electrophotographic image forming apparatus. FIG. 1 is a sectional view of the color laser beam printer.

In the beginning, an image forming operation of the color laser beam printer is described. As illustrated in FIG. 1, the image forming apparatus has an electrophotographic photosensitive member 2 (hereinafter, referred to as photosensitive drum). Around the photosensitive drum 2, there are arranged a charging roller 3, an exposure device 4, a number V of developing devices 18*a* to 18*d* (where V is a natural number, and four in this case), and a cleaning device 6. The charging roller 3 is a charging means for uniformly charging the photosensitive drum 2. The exposure device 4 is an exposing means for forming an electrostatic latent image by irradiating the photosensitive drum 2 with a laser beam in accordance with image information. The developing devices 18*a* to 18*d* are developing means for visualizing the latent image formed on the photosensitive drum 2 through development using developer of corresponding colors. Note that, in Embodiment 1, the corresponding colors are yellow, magenta, cyan, and black. The developing device 18*a* contains a yellow developer (not shown), the developing device 18*b* contains a magenta developer (not shown), the developing device 18*c* contains a cyan developer (not shown), and the developing device 18*d* contains a black developer (not shown). The developing devices 18*a* to 18*d* each develop the latent image formed on the photosensitive drum 2 using the respective developer (not shown). Further, the cleaning device 6 is a cleaning means for removing the residual developer on the photosensitive drum 2.

First, the photosensitive drum 2 is synchronized with the rotation of an intermediate transfer belt (member to which a rotation force is transmitted) 7, and then rotated in the direction indicated by the arrow (counterclockwise) of FIG. 1. The surface of the photosensitive drum 2 is uniformly charged by the charging roller 3, and the photosensitive drum 2 is irradiated from the exposure device 4 for forming a yellow image. Through this process, a yellow electrostatic latent image is formed on the photosensitive drum 2.

Figure 4:
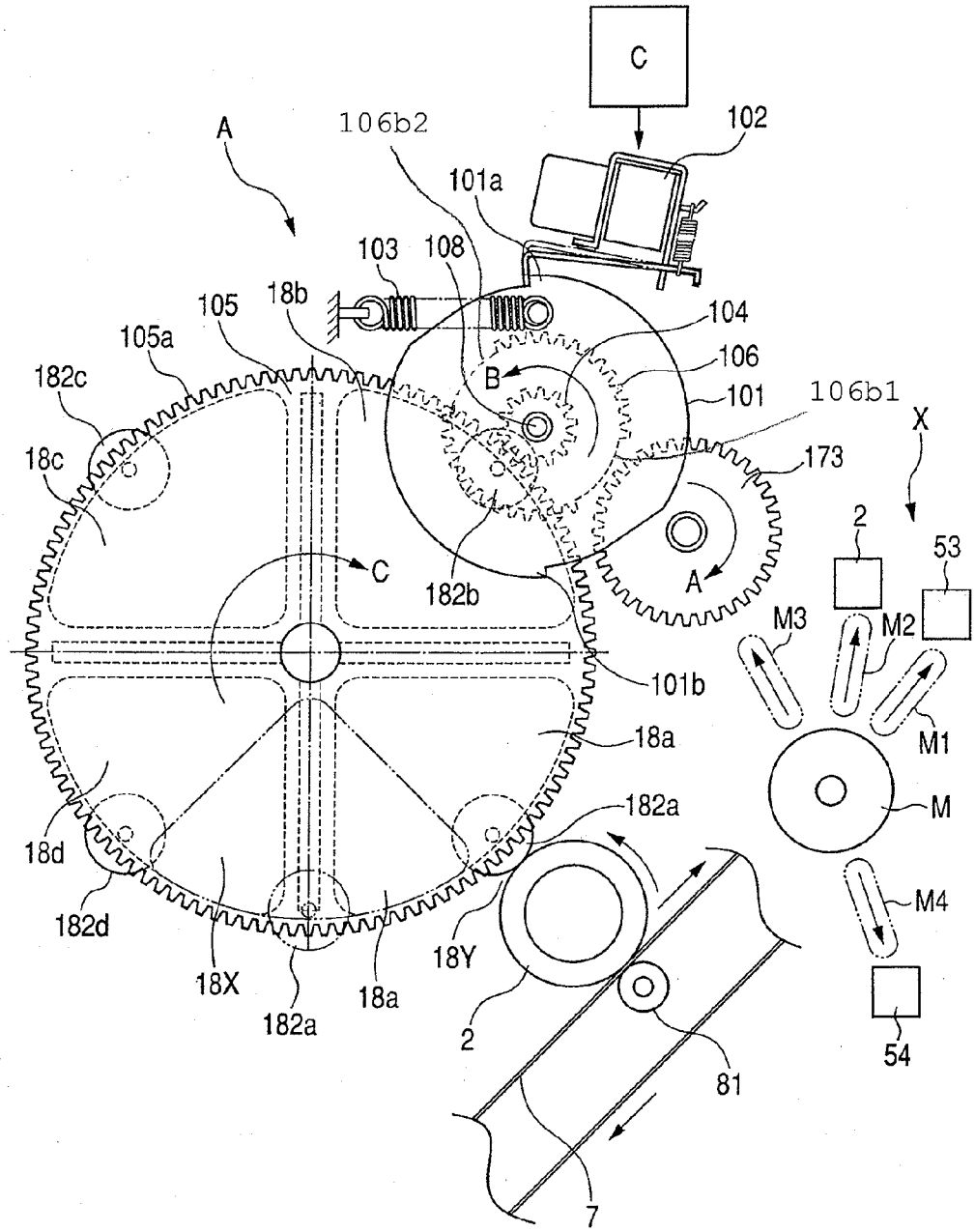
FIG. 4 is a front view illustrating another example of the drive transmission mechanism according to Embodiment 1 of the present invention.

Simultaneously with the formation of the yellow electrostatic latent image, a rotary (rotary supporting member) 105 rotatable and capable of supporting the four developing devices 18*a* to 18*d* is rotated about a shaft 105*b* by using a drive transmission mechanism (described later). Accordingly, the rotary 105 is rotated, and the yellow developing device 18*a* is arranged at a development position 18Y at which the yellow developing device 18*a* faces the photosensitive drum 2 (FIG. 4). Note that, the rotary 105 is a rotatable rotary supporting member. Further, the rotary 105 supports the plurality of developing devices 18*a* to 18*d* in their rotational direction C (FIGS. 2 and 4) at equal intervals.

However, the rotary 105 may not support the plurality of developing devices 18*a* to 18*d* at equal intervals. For example, in the case where the sizes of the developing devices differ from each other, it is only necessary for the rotary 105 to support each of the developing devices at an interval according to each of the sizes. In this case, the rotary 105 is rotated at an angle according to the size of each of the developing devices.

Further, in order that the yellow developer adheres to the latent image formed on the photosensitive drum 2, a voltage of the same charging polarity and of substantially the same potential as those of the photosensitive drum 2 is applied to a developing roller 182*a*. Through this process, the yellow developer adheres to the latent image, whereby the latent image is developed. That is, a yellow developer image is formed on the photosensitive drum 2.

After that, a voltage of a reverse polarity to that of the developer is applied to a primary transfer roller 81 arranged inside the intermediate transfer belt 7. The yellow developer image formed on the photosensitive drum 2 is thereby primarily transferred onto the intermediate transfer belt 7.

When the primary transfer of the yellow developer image is ended as described above, the respective developing devices (18*b* to 18*d*) of magenta, cyan, and black are sequentially positioned to the development position 18Y by the rotation of the rotary 105. Then, as in the case of yellow, formation of the latent image, development, and primary transfer of each of magenta, cyan, and black are sequentially performed. As a result, the four developer images of the corresponding colors are superimposed on the intermediate transfer belt 7.

During this process, a secondary transfer roller 82 is held in a non-contact state with the transfer belt 7. Simultaneously therewith, a cleaning unit 9 for removing the residual developer on the transfer belt 7 is also held in a non-contact state with the transfer belt 7.

Meanwhile, sheets S serving as recording medium are accommodated in a stacked manner in a feeding cassette 51 provided at the lower portion of the apparatus. By the rotation of a feeding roller 52, each of the sheets S is fed from the cassette 51 while separated from each other. The sheet S is fed to a pair of registration rollers 53 (pair of conveyor rollers, member to which a rotation force is transmitted). The pair of registration rollers 53 sends forth the fed sheet S to the portion between the transfer belt 7 and the transfer roller 82. Meanwhile, the transfer roller 82 is held in pressure contact with the transfer belt 7 (in a state illustrated in FIG. 1).

Further, a voltage of a reverse polarity to that of the developer is applied to the transfer roller 82. As described above, the four developer images of the respective colors superimposed on the transfer belt 7 are collectively transferred (secondarily-transferred) onto the surface of the fed sheet S.

The sheet S onto which the developer image is transferred is sent to a fixing device 54 (fixing means, fixing device, member to which a rotation force is transmitted). In the fixing device 54, the sheet S is heated and pressurized. Then, the developer image is fixed to the sheet S, whereby a colored image is formed on the sheet S. After that, the sheet S passes the fixing device 54 to be discharged to a discharge portion formed on an upper cover 55.

Figure 2:
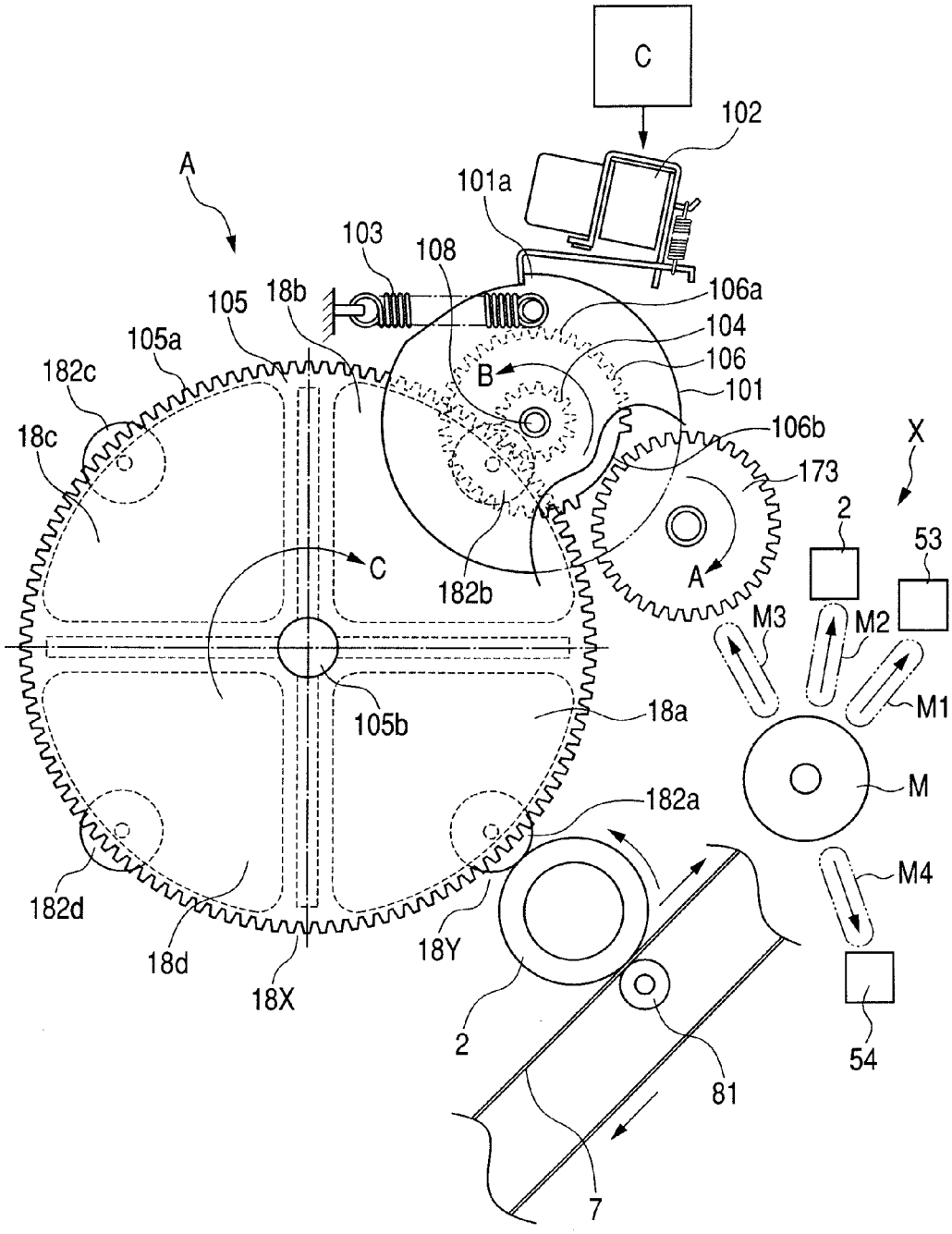
FIG. 2 is a front view illustrating a construction of a drive transmission mechanism according to Embodiment 1 of the present invention.
Figure 3:
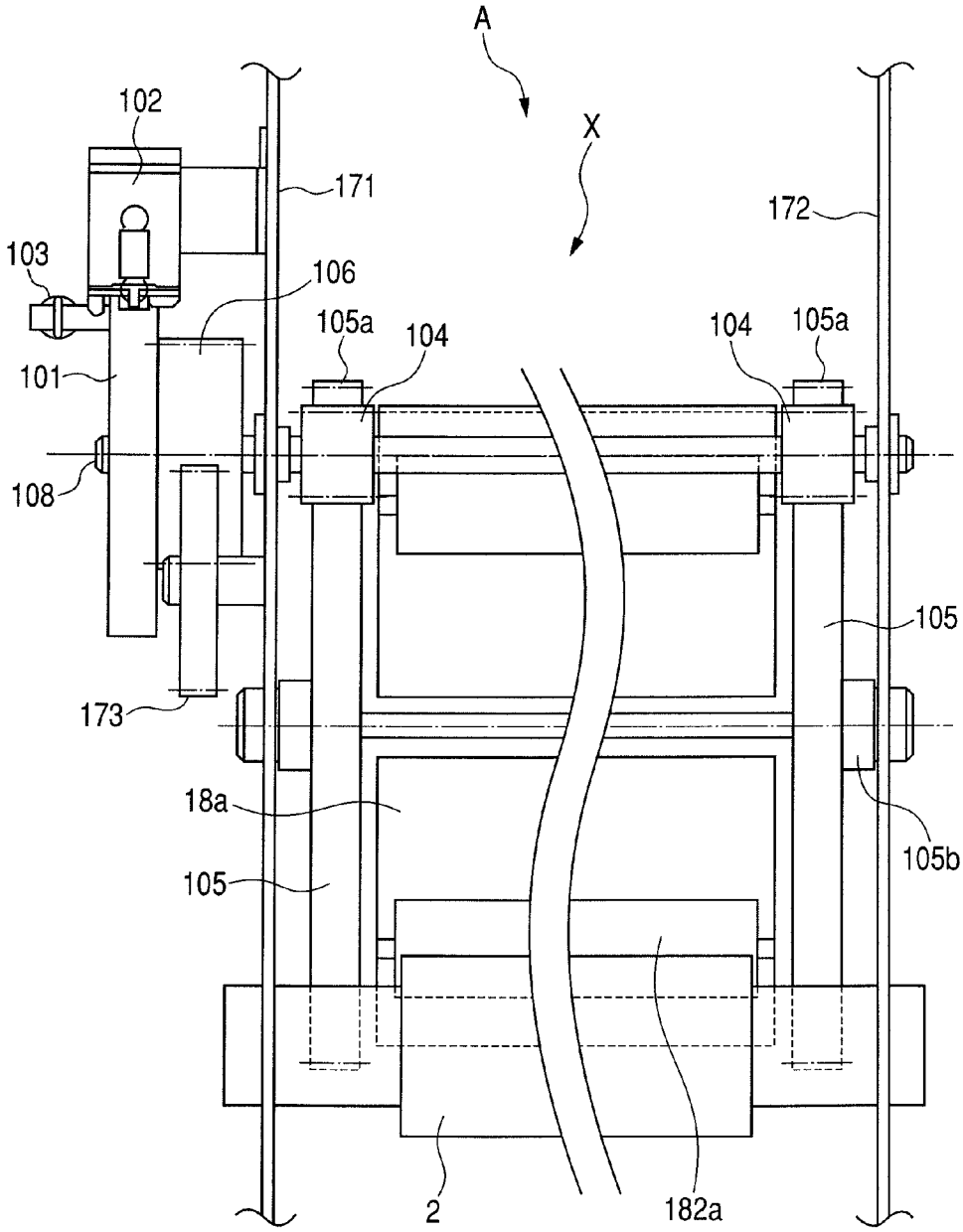
FIG. 3 is a right side view of the drive transmission mechanism according to Embodiment 1 of the present invention.

Now, with reference to FIGS. 2 and 3, the drive transmission mechanism for rotating the rotary 105 is described. FIG. 2 is a front view illustrating a construction of the drive transmission mechanism, and FIG. 3 is a right-side view of the drive transmission mechanism illustrated in FIG. 2 as seen from the right side. Note that, FIG. 2 does not illustrate main-body frames 171 and 172 illustrated in FIG. 3. Further, FIG. 3 does not illustrate the photosensitive drum 2, the transfer belt 7, and the transfer roller 81 which are illustrated in FIG. 2.

The drive transmission mechanism illustrated in FIGS. 2 and 3 rotates the rotary 105 about the shaft 105*b*. Accordingly, the drive transmission mechanism sequentially moves the four developing devices 18*a* to 18*d* supported by the rotary 105 to the development position 18Y at which each of the developing devices faces the photosensitive drum 2.

Hereinafter, the construction of the drive transmission mechanism is described.

A drive gear (driving member) 173 is rotatably supported with respect to an image forming apparatus main body A. The gear 173 is rotated in one direction (direction indicated by the arrow A of FIG. 2, in this case), while receiving a rotation force from a motor M (drive source). Note that, as long as the transmission of the rotation force is possible, a rotation force transmission for transmitting a rotation force from the motor M to the gear 173 may be appropriately constructed as follows: the gears or the like (rotation force transmission mechanism M1, FIG. 4) for transmitting the rotation force to the pair of registration rollers (pair of conveyor rollers) 53 may be divided therefor; alternatively, the gears or the like (rotation force transmission mechanism M2, FIG. 4) for transmitting the rotation force to the photosensitive drum 2 may be divided therefor. Further, the gears or the like (rotation force transmission mechanism M4, FIG. 4) for transmitting the rotation force to the fixing device 54 may be divided therefor. In Embodiment 1, the rotation force from a brush motor M which cannot be controlled in its rotating speed is transmitted to the gear 173 through an intermediation of a rotation force transmission mechanism M3 (FIG. 3).

In this case, the rotation force transmission mechanisms M1 to M4 are not limited to gear trains, but may be members such as belts as long as the members are capable of transmitting a rotation force.

Meanwhile, the member to which a rotation force is transmitted which is rotated while receiving the rotation force from the motor M is not limited to the above-mentioned construction. As the member to which a rotation force is transmitted, there can be employed at least any one of the conveyor rollers (registration rollers) 53 for transferring the sheet S, the fixing device 54 for fixing to the sheet S a developer image transferred thereto, and the photosensitive drum 2.

Further, examples of the rotation force transmission mechanism for transmitting the rotation force to the member to which a rotation force is transmitted from the motor M include the rotation force transmission mechanisms M1, M2, and M3.

Still further, the motor M is not limited to a brush motor, but may be a motor such as a stepping motor, a brush DC motor, and brushless DC motor. In Embodiment 1, although rotating speed of each thereof cannot be controlled, any one of the motors can be used which are less expensive than pulse motors of the same output. In addition, in the case of having the same output as that of the pulse motors, those motors are smaller than the pulse motors. Accordingly, in Embodiment 1, the advantages of those motors are effectively utilized.

The rotary 105 holds the developing devices 18*a* to 18*d*, and is rotatably attached to the main-body frames 171 and 172. The developing devices 18*a* to 18*d* may be fixed or detachable to the rotary 105. Note that, in Embodiment 1, there are adopted as the developing devices the developing cartridges detachably mounted to the rotary 105. The developing cartridges are detachable to the rotary 105, so maintenance thereof by users is facilitated. Further, a rotary gear 105*a* is provided on the outer periphery of the rotary 105. The rotary gear 105*a* is rotated integrally with the rotary 105. The gear 105*a* is a rotary supporting member gear having a number Y of teeth (where Y is a natural number). A shaft 108, which is rotatably provided with respect to the apparatus main body A, is provided with a rotary drive gear 104 by means of a parallel pin. The gear 104 is a transmission gear (first transmission gear member) which has a number X of teeth (where X is a natural number) and transmits the rotation force from the drive gear 173 rotated in one direction. The gear 105*a* meshes (is engaged) with the gear 104. Therefore, the rotary 105 is rotated in synchronism with the gear 104.

The developing devices 18*a* to 18*d*, which are supported by the rotary 105, have the developing rollers 182*a* to 182*d*, respectively. Each of the developing rollers 182*a* to 182*d* is formed of an elastic member, and has a predetermined elasticity. Each of the developing rollers 182*a* to 182*d* develops the latent image while held in pressure contact with the photosensitive drum 2.

The shaft 108 is provided with a trigger cam 101 by means of a parallel pin. Thus, the cam 101 is rotated in synchronism with the shaft 108. The cam 101 has a number M (assuming M to be a natural number, one in this case) of claw portions (engaging portions) 101*a* engageable with an electric actuator (described later). Notably, the cam (rotary member) 101 is rotated integrally with the gear 104.

There is given an extension spring as an example of a trigger spring 103, one end of which is fixed to the apparatus main body A, and the other end of which is rotatably provided to the cam 101. The spring 103 is a biasing member (elastic member) for biasing the cam 101 in a rotational direction thereof (direction indicated by the arrow B of FIG. 2, in this case).

Solenoid (engaging member) 102 is fixed to the apparatus main body A. The solenoid 102 locks the claw portion (engaging portion) 101*a* provided to the cam 101. With this construction, by the elasticity of the spring 103, the cam 101 is prevented from being rotated in a direction indicated by the arrow B (FIG. 2). In this state, the solenoid 102 is detachably engaged with the claw portion (engaging portion) 101*a* provided to the cam 101 so as to stop the rotation of the cam 101.

Further, a voltage can be applied to the solenoid 102 from a control unit C (FIG. 4) serving as a control means. The solenoid 102 is an electric actuator (engaging member) which is turned ON/OFF according to the application of the voltage. The application of the voltage to the solenoid 102 from the unit C causes the solenoid 102 to separate from the claw portion 101*a*. Accordingly, the cam 101 is rotated in the direction indicated by the arrow B by the elasticity of the spring 103. When the voltage applied to the solenoid 102 is turned OFF, the solenoid 102 is engaged with the claw portion 101*a*. In this manner, the rotation of the cam 101 is regulated.

Still further, the shaft 108 is provided with a partially-toothless gear 106. The partially-toothless gear 106 is fixed to the side of the cam 101. That is, in Embodiment 1, the partially-toothless gear 106 is integrated with the trigger cam 101. In addition, the partially-toothless gear 106 is not a complete gear. As illustrated in FIG. 2, in the state in which the rotation of the cam 101 is regulated by the solenoid 102, the partially-toothless gear 106 has the teeth partially cut (toothless portion) so as not to be engaged with the gear 173. That is, the gear 106 has a gear portion 106*a* engageable with the gear 173, and has a number M of toothless portion 106*b* (one in this case) facing the drive gear 173 in the state in which the solenoid 102 is engaged with the claw portion 101*a* of the trigger cam 101. The gear (second transmission gear member) 106 transmits to the cam 101 the rotation force of the gear (driving member) 173 which is rotated in one direction while receiving the rotation force from the motor M.

Accordingly, the cam 101, the drive gear 104, the partially-toothless gear 106, and the shaft 108 are integrated with one another, thereby being rotated about the shaft 108. The drive transmission mechanism is constituted by the above-mentioned members.

Further, in the drive transmission mechanism, the natural numerical values X, M, Y, and V are set such that (X/M) is an aliquot part of (Y/V).

In this case, when the voltage is applied to the solenoid 102, the claw portion 101*a* of the trigger cam 101 is disengaged from the solenoid 102. Accordingly, the restraining force of the solenoid 102 imparted to the cam 101 is eliminated, and then the cam 101 is rotated in the direction indicated by the arrow B by the tension force (biasing force, elastic force) of the spring 103. As a result, the partially-toothless gear 106 synchronized with the cam 101 is rotated, whereby the gear portion 106*a* of the partially-toothless gear 106 is engaged with the drive gear 173. That is, the application of the voltage to the solenoid 102 causes the drive transmission mechanism to be rotated in synchronism therewith in the direction indicated by the arrow B of FIG. 2. Further, assuming that the time required for one revolution of the drive transmission mechanism is t1, the time for applying a voltage to the solenoid 102 is t2, and the response time of the solenoid 102 is 0, the drive transmission mechanism makes one revolution when t1>t2 is satisfied. As a result, the cam 101 is locked by the solenoid 102, whereby the rotation is stopped. That is, whenever the claw portion 101*a* of the cam 101 is disengaged from the solenoid 102, the cam 101 makes a 1/M revolution (one revolution in this case) in the direction indicated by the arrow B. Further, the rotation is stopped. Still further, when the solenoid 102 is engaged with the claw portion 101*a*, the cam 101 stops the rotation.

Meanwhile, the gear 104 is engaged with the gear 105*a*. Thus, according to the rotation of the gear 106, the rotary 105 also rotates in a direction indicated by the arrow C (FIG. 2). In this case, the four-color developing devices (18*a* to 18*d*) are sequentially moved to the development position 18Y (the state of FIG. 2). For this reason, the assumption is made that the number Y of teeth of the gear 105*a* is a quadruple of the number X of teeth of the drive gear 104. For example, the number Y of teeth of the gear 105*a* is 80, and the number X of teeth of the drive gear 104 is 20. Note that, at the development position 18Y, the developing rollers 182 are held in pressure contact with the photosensitive drum 2.

In this case, when the voltage is applied to the solenoid 102 for the time t2 (<t1), the subsequent developing device 18*b* is moved by the rotary 105 to the development position 18Y to be stopped thereat. Further, when the development by the developing device 18*c* is performed after the development by the developing device 18*b*, the voltage is reapplied to the solenoid 102 for the time t2 (<t1). As a result, the subsequent developing device 18*c* is moved by the rotary 105 to the development position 18Y to be stopped thereat.

Meanwhile, as described above, the assumption is made that the number Y of teeth of the gear 105*a* is a quadruple of the number X of teeth of the drive gear 104. However, any number is possible as long as the multiple thereof is a natural number multiple of 4. For example, the assumption is made that the number Y of teeth of the gear 105*a* is 120, and the number X of teeth of the drive gear 104 is 15 (120:15=8:1, 8 times). In this case, the voltage is applied to the solenoid 102 for the time t2 (<t1) twice at sufficient intervals; alternatively, the voltage is applied to the solenoid 102 for the time t2 under the condition that t1<t2<2×t1 is satisfied. As a result, the developing devices 18*a* to 18*d* can be sequentially moved to the development position 18Y. Further, the developing devices 18*a* to 18*d* can be stopped at the development position 18Y. Notably, the application of the voltage to the solenoid 102 is controlled by the control unit C (FIG. 4).

Further, the rotation of the rotary 105 which supports the developing devices 18*a* to 18*d* is stopped as follows: First, the application of the voltage to the solenoid 102 is released, whereby the solenoid 102 is engaged with the claw portion 101*a*. Then, as illustrated in FIG. 2, the rotary 105 stops rotating at the position where the toothless portion 106*b* of the partially-toothless gear 106 faces the drive gear 173.

The drive transmission mechanism where the natural numerical values are set as described above such that (X/M) is an aliquot part of (Y/V) can be structured as follows: That is, whenever the cam 101 makes a 1/M revolution, the rotation force (driving force) is transmitted to the gear 105*a* from the drive gear 104 which rotates integrally with the cam 101. Then, the rotary 105 can be stopped after rotated by an angle W which is an aliquot part of (360°/V).

That is, in Embodiment 1, the motor may not be independently provided which rotates the rotary 105 so as to accurately determine the position of the rotary 105, which can be controlled in its rotating speed. In Embodiment 1, even in the construction without the motor being independently provided therewith, which can be controlled in its rotating speed, the developing devices mounted to the rotary 105 can be positively moved to the development position, and then can be stopped thereat. That is, downsizing and reduction in cost of the apparatus can be realized. Further, even without the motor being independently provided, which can be controlled in its rotating speed, each of the developing devices mounted to the rotary can be positively moved to the development position, and then can be stopped thereat.

Further, as described above, each of the Y number of teeth of the gear 105*a* and the X number of teeth of the drive gear 104 is set to 4N (N is a natural number of 2 or larger). As a result, except the position (development position) at which each of the developing rollers 182*a* to 182*d* is held in pressure contact with the photosensitive drum 2, the rotary 105 can be stopped at the position in which each of the developing rollers 182*a* to 182*d* is out of contact with the photosensitive drum 2.

That is, in Embodiment 1, the rotary 105 is rotated by 45 degrees about the shaft 105*b* from the development position 18Y to be stopped. Accordingly, the developing devices 18*a* to 18*d* can be stopped at a standby position 18X at which their respective developing rollers 182*a* to 182*d* are out of contact with the photosensitive drum 2. FIG. 4 illustrates the state in which the rotary 105 is rotated by 45 degrees to be stopped, and then the developing device 18*a* is moved from the development position 18Y to the standby position 18X to be stopped thereat.

In this case, the developing rollers 182*a* to 182*d* can standby without being in contact with the photosensitive drum 2. Accordingly, the photosensitive drum 2 or the developing rollers 182*a* to 182*d* can be prevented from causing deterioration of some kind due to the pressure contact of the developing rollers with the photosensitive drum 2 even outside during the development.

Further, while the four-color developing device is assumed herein, the apparatus may be of three- or two-color type. In this case, the number Y of teeth of the gear 105*a* is set to 2×P times (where P is a natural number) or 3×Q times (Q is a natural number) of the number X of teeth of the rotary drive gear 104, whereby the same effect can be obtained. The same holds true in the case of a five-color or more type. Incidentally, three developing devices and two developing devices are mounted to the rotary 105 in the cases of the three-color type and the two-color type, respectively.

Further, FIG. 2 illustrates the single claw portion 101*a* (engaging portion) of the trigger cam 101. However, as illustrated in FIG. 4; multiple claw portions 101*a* may be provided at equal intervals (equal angles). For example, FIG. 4 illustrates two claw portions 101*a* and 101*b* of the trigger cam 101, and two toothless portions 106*b*1 and 106*b*2 of the partially-toothless gear 106 which are correspondingly provided with each other. When the ratio of the number X of teeth of the drive gear 104 to the number Y of teeth of the rotary gear 105*a* is 1:2, the rotary 105 can be rotated by a ¼ rotation to be stopped. That is, four-color developing devices are sequentially rotated to the development position to be stopped thereat.

In this context, the assumption is made that the number of teeth of the drive gear 104 is X, the number of teeth of the rotary gear 105*a* is Y, and the number of the claw portions 101*a* of the cam 101 is M. Thus, the rotary 105 can be rotated at the angle (pitch) W obtained under the condition that 360/(X×M/Y)=W° is satisfied to be stopped. Note that, in order to stop each of the V-color developing devices at the development position, W should be an aliquot part of (360°/V).

As described above, in Embodiment 1, the drive transmission mechanism has a rotation force transmission unit X which may come into a stop state in which transmission of the rotation force from the motor M is stopped, and an operation state in which transmission of the rotation force from the motor M is performed. In the operation state, the rotation force transmission unit X rotates, while receiving the rotation force from the motor M, the rotary 105 by a predetermined amount to sequentially move the developing devices 18*a* to 18*d* to the development position 18Y. Herein, the rotation force transmission unit X includes the gear 173, the gear 106, the gear 104, the gear 105*a*, the cam 101, the solenoid 102, and the spring 103.

Note that, in the developing state as illustrated in FIG. 2, unless the voltage is applied to the solenoid 102, the rotary 105 is regulated by the solenoid 102 so as not to be rotated in the direction indicated by the arrow C (FIG. 2). Further, the cam 101 is biased by the elasticity of the trigger spring 103 also in the direction opposite to the direction indicated by the arrow C. Thus, the rotary 105 cannot be rotated without counteracting force to the elasticity. As a matter of course, the spring 103 exerts sufficient elasticity to prevent the rotary 105 from being rotated in the direction opposite to the direction indicated by the arrow C. That is, in the developing state illustrated in FIG. 2, the rotary 105 is in a fixed state, thereby enabling reliable development.

Embodiment 2

Figure 5:
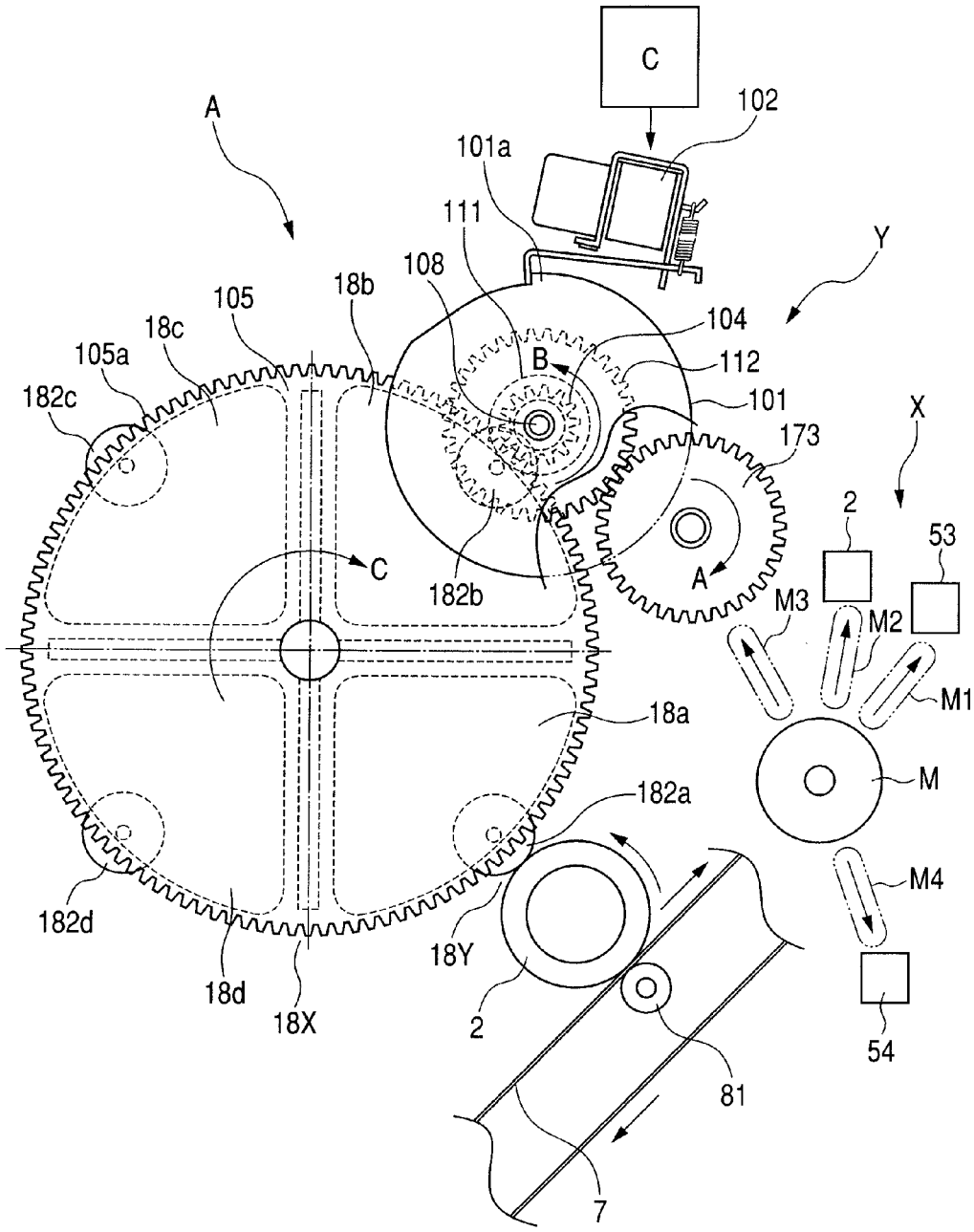
FIG. 5 is a front view illustrating a construction of a drive transmission mechanism according to Embodiment 2 of the present invention.
Figure 6:
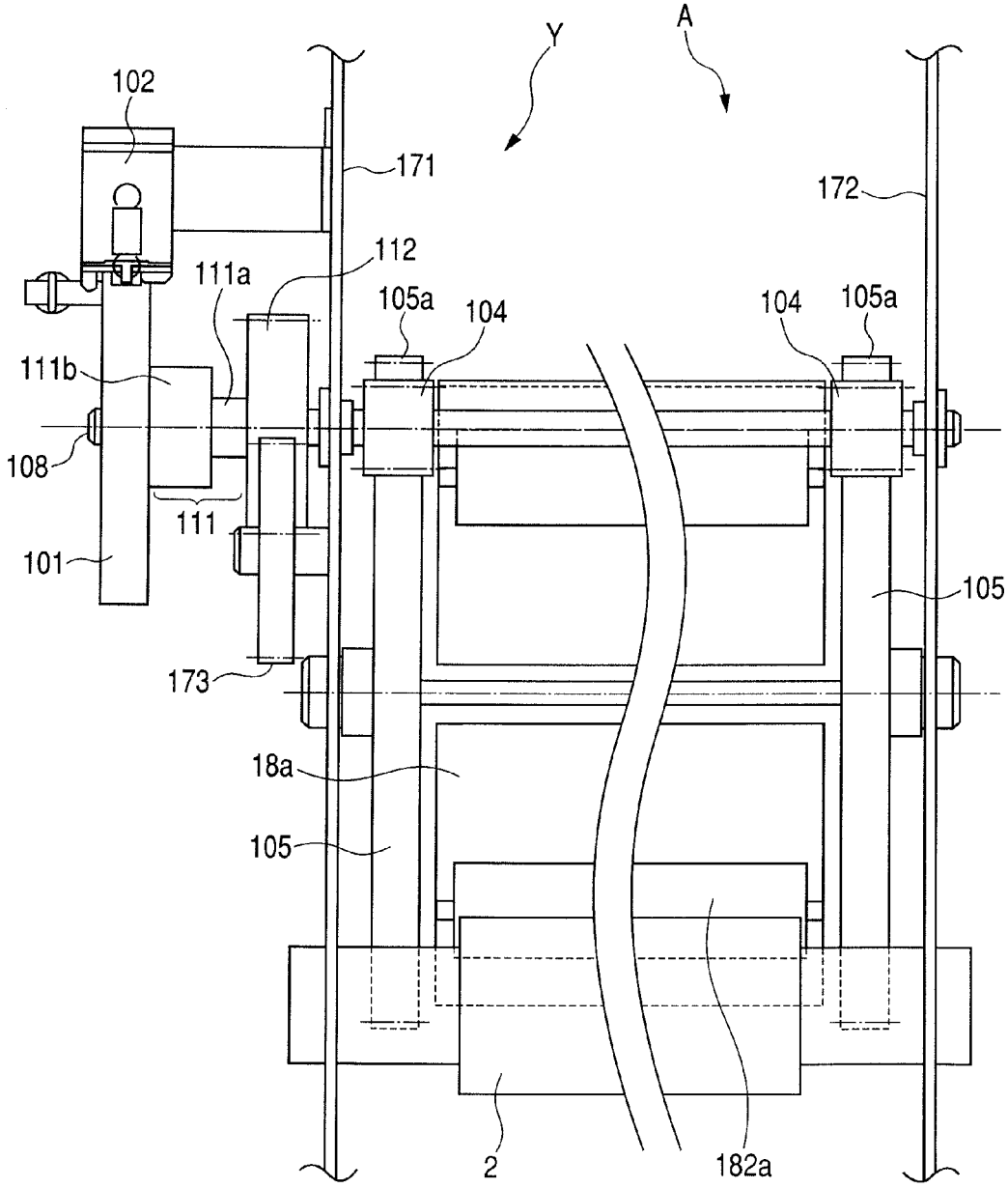
FIG. 6 is a right side view of the drive transmission mechanism according to Embodiment 2 of the present invention.

Next, with reference to FIGS. 5 and 6, another mode of the drive transmission mechanism for rotating the rotary 105 is described. FIG. 5 is a schematic front view illustrating a construction of the drive transmission mechanism, and FIG. 6 is a right-side view of the drive transmission mechanism illustrated in FIG. 5 as seen from the right side. Note that, FIG. 5 does not illustrate main-body frames 171 and 172 illustrated in FIG. 6. Meanwhile, FIG. 6 does not illustrate the photosensitive drum 2, the transfer belt 7, and the transfer roller 81 which are illustrated in FIG. 5. Note that, in Embodiments 2 and 3, members having the same functions as those in Embodiment 1 described above are neither described nor illustrated.

In the drive transmission mechanism according to Embodiment 2, unlike Embodiment 1, a torque transmitting means 111 is added, a slipping gear 112 is substituted for the partially-toothless gear 106, and the trigger spring 103 is omitted.

The slipping gear 112 is rotatably provided with respect to the shaft 108, and constantly engaged with the drive gear 173.

Examples of the torque transmitting means 111 include a torque limiter. The torque transmitting means 111 is rotatably provided with respect to the shaft 108, and includes a fixed side (fixed portion) 111*a* and a slipping side (slipping portion) 111*b*. The fixed side 111*a* is engaged with the slipping gear 112 so as to be rotated in synchronism with the slipping gear 112. The slipping side 111*b* is engaged with the trigger cam 101 so as to be rotated in synchronism with the trigger cam 101. While the fixed side 111*a* and the slipping side 111*b* are normally rotated in synchronism with each other, both the fixed side 111*a* and the slipping side 111*b* slip when the torque not less than a predetermined torque T is generated therebetween, and are not rotated in synchronism with each other.

As described above, since the slipping gear 112 receives a rotation force from the drive gear 173, the slipping gear 112 is rotated with the fixed side 111*a* in the direction indicated by the arrow B (of FIG. 5). Meanwhile, the slipping side 111*b*, the cam 101, the drive gear 104, and the shaft 108 receive a rotation force so as to be rotated in the direction indicated by the arrow B (of FIG. 5). However, the claw portion 101*a* of the cam 101 is locked by the solenoid 102. Thus, the fixed side 111*a* and the slipping side 111*b* of the torque transmitting means 111 are in the slipping state, and the rotation force, which is transmitted to the cam 101, of the slipping gear 112 is interrupted, so the rotation of the drive transmission mechanism is stopped.

In this state, when the voltage is applied to the solenoid 102, the claw portion 101*a* is disengaged from the solenoid 102. Then, the fixed side 111*a* and the slipping side 111*b* are rotated in synchronism with each other. Accordingly, the rotation force of the slipping gear 112 is transmitted to the cam 101, whereby the drive transmission mechanism is rotated. That is, the cam 101, the drive gear 104, the shaft 108, the torque transmitting means 111, and the slipping gear 112 are rotated integrally with one another in the direction indicated by the arrow B (FIG. 5). As a result, the rotary 105 can be rotated. The subsequent operations are the same as those in Embodiment 1.

As described above, in Embodiment 2, the drive transmission mechanism has a rotation force transmission unit Y which may come into a stop state in which transmission of a rotation force from the motor M is stopped, and an operation state in which transmission of a rotation force from the motor M is performed. In the operation state, the rotation force transmission unit Y rotates, while receiving the rotation force from the motor M, the rotary 105 by a predetermined amount to sequentially move the developing devices 18*a* to 18*d* to the development position 18Y. Herein, the rotation force transmission unit Y includes the gear 173, the gear 112, and the gear 104, the gear 105*a*, and the solenoid 102.

In Embodiment 2, the same effect can be obtained as that in Embodiment 1.

Further, both the fixed side 111*a* and the slipping side 111*b* slip when the torque larger than the predetermined torque T is applied therebetween. Thus, even in the state in which the rotary 105 cannot be rotated due to the foreign body jammed therein, the fixed side 111*a* and the slipping side 111*b* slip when the voltage is applied to the solenoid 102 to rotate the rotary 105. For this reason, the drive torque (rotation torque) larger than T is set so as not to be transmitted from the drive source (not shown), whereby the apparatus main body is prevented from being broken down.

Embodiment 3

Figure 7:
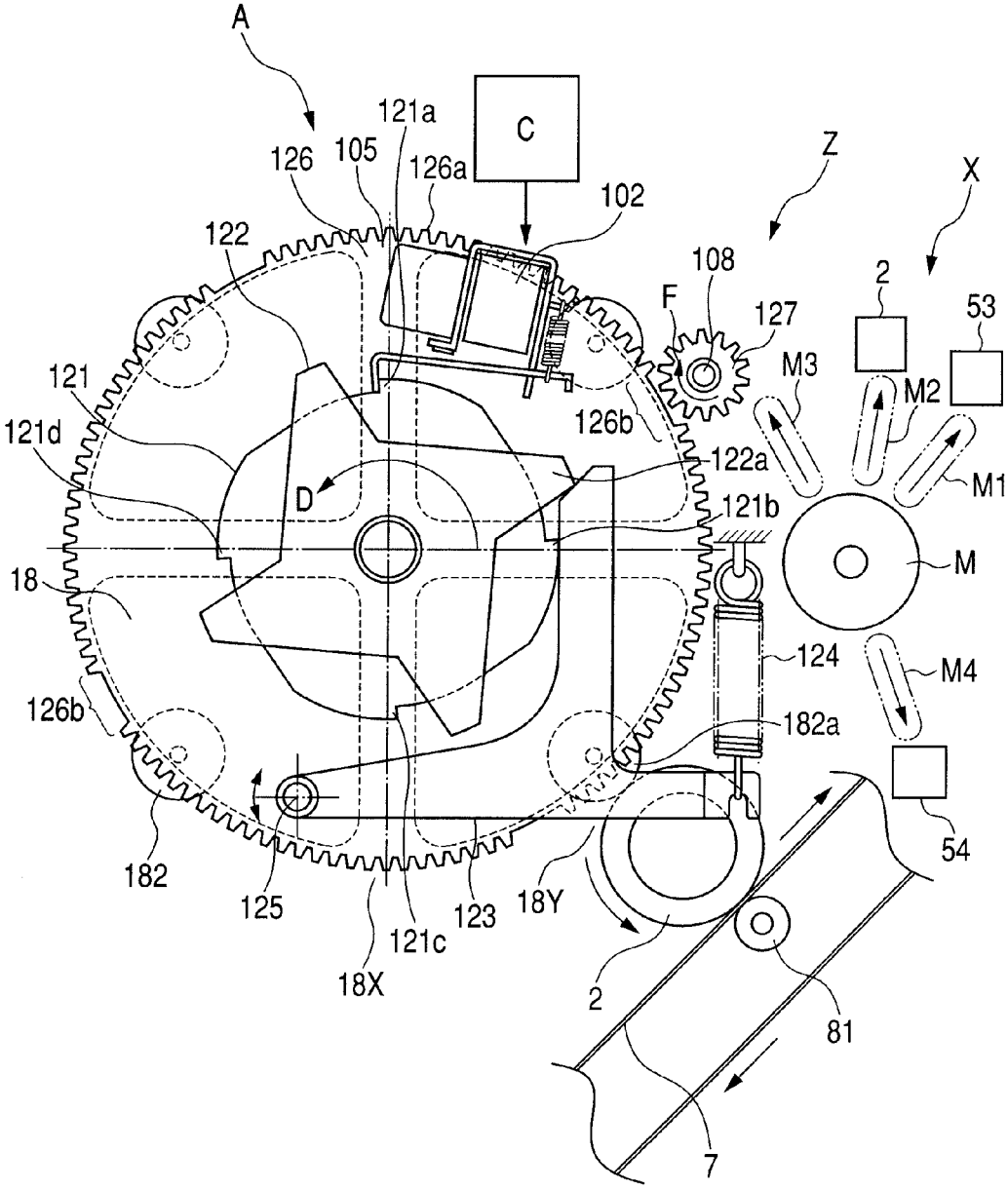
FIG. 7 is a front view illustrating a construction of a drive transmission mechanism according to Embodiment 3 of the present invention.
Figure 8:
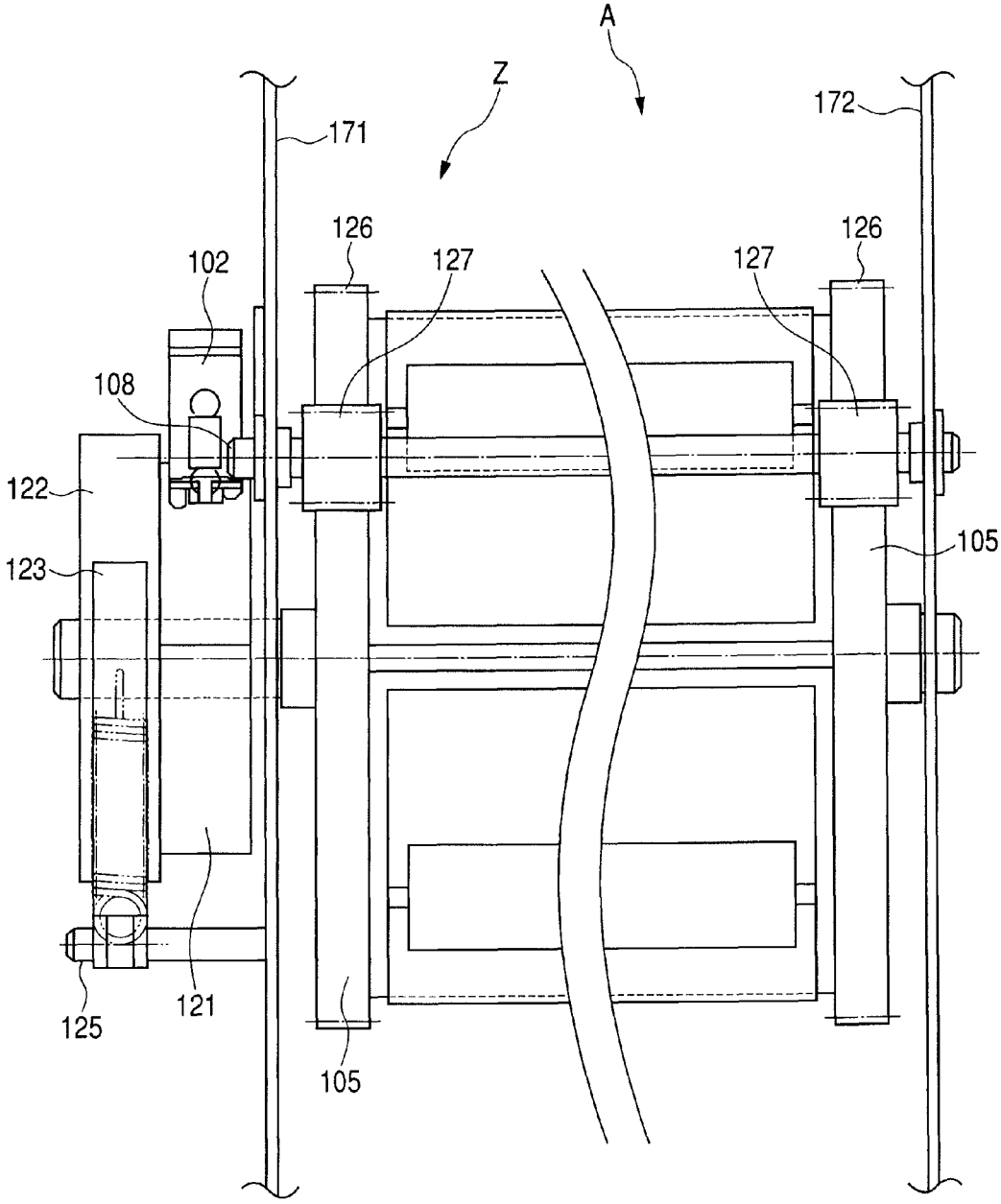
FIG. 8 is a right side view of the drive transmission mechanism according to Embodiment 3 of the present invention.

Next, with reference to FIGS. 7 and 8, another mode of the drive transmission mechanism for rotating the rotary 105 is described. FIG. 7 is a schematic front view illustrating a construction of the drive transmission mechanism, and FIG. 8 is a right-side view of the drive transmission mechanism illustrated in FIG. 7 as seen from the right side. Note that, FIG. 8 does not illustrate the photosensitive drum, the intermediate transfer belt, the primary transfer roller, and the like. Further, in Embodiment 3, while the rotary 105 rotates in the direction opposite to that in Embodiments 1 and 2, the assumption is made such that there involves no problem with the developing.

The drive transmission mechanism illustrated in FIGS. 7 and 8 rotates the rotary 105, whereby the four developing devices 18*a* to 18*d* supported by the rotary 105 are sequentially switched to be moved to the development position in which each of the developing devices faces the photosensitive drum 2. Hereinafter, a construction of the drive transmission mechanism is described.

The rotary 105 holds the four developing devices 18 (mounted thereto), and is rotatably provided with respect to the main-body frames 171 and 172. As described above, the four developing devices 18 may be fixed or detachable to the rotary 105. Further, a rotary gear 126 is provided on the outer periphery of the rotary 105. The rotary gear 126 rotates integrally with the rotary 105. The gear 126 has a gear portion 126*a* engageable with a rotary drive gear 127 being rotated in one direction. Further, the gear 126 has the number V of toothless portions 126*b* facing the drive gear 127 when the solenoid 102 is engaged with any one of claw portions 121*a* to 121*d*. In this case, the gear 126 has four toothless portions 126*b* at equal angles.

A cam 121 serving as a rotary member is engaged (may be integrated) with the rotary 105 so as to be rotatable in synchronism therewith, and has the number V of (four in this case) claw portions (engaged portions) 121*a* to 121*d* engageable with the solenoid 102. In this case, the claw portions 121*a* to 121*d* of the cam 121 are arranged at equal angles.

Further, the claw portions 121*a* to 121*d* of the cam 121 and the four partially-toothless gears 126*b* of the gear 126 are set to the positions corresponding to the development position.

A biasing cam 122 is engaged (may be integrated) with the cam 121 so as to be rotatable in synchronism therewith. The biasing cam 122 is a guide member having the number V of (four in this case) guide portions 122*a*.

The trigger lever 123 is a lever member engaged with the guide portions 122*a* of the biasing cam 122. The lever 123 is provided rotatably about a shaft 125 which is provided to the apparatus main body.

A biasing spring 124 is a biasing member (elastic member) for biasing the lever 123 so as to bias the cam 121 in a rotational direction (direction indicated by the arrow D of FIG. 7). Examples of the biasing spring 124 include an extension spring, one end of which is fixed to the apparatus main body, and the other end of which is provided to the lever 123. Further, the spring 124 imparts the rotation force to the lever 123. Accordingly, the lever 123 biases the biasing cam 122, the cam 121, and the rotary 105 in a direction indicated by the arrow D (FIG. 7) by the elastic force (spring force) of the spring 124.

The rotary drive gear (driving member) 127 receives a rotation force from the drive source (not shown), and is constantly rotated in one direction (direction indicated by the arrow F of FIG. 7). Note that, as described above, as long as the drive source (not shown) has the rotation force, the drive source may be appropriately applicable when obtained in the following manners: The gears or the like which drives conveyor roller (not shown) may be divided therefor; alternatively, the gears which drive the photosensitive drum 2 may be divided therefor.

The above-mentioned members constitute the drive transmission mechanism. Whenever the claw portions 121*a* to 121*d* of the cam 121 are locked and disengaged from the solenoid 102, the gear portion 126*a* of the gear 126 which is rotated in synchronism with the cam 121 is engaged with the drive gear 127. Then, the drive transmission mechanism rotates the rotary 105 by the angle W which satisfies (360°/V), and then stops the rotary 105.

In the state illustrated in FIG. 7, the solenoid 102 is engaged with the claw portion 121*a* of the cam 121. With this construction, the toothless portion 126*b* of the gear 126 is positioned so as to face the drive gear 127, so the rotation force is not transmitted to the gear 126. Accordingly, the rotation of the drive transmission mechanism is stopped. Further, in the state illustrated in FIG. 7, the developing rollers 182 are elastically held in pressure-contact with the photosensitive drum (not shown).

In this state, when the voltage is applied to the solenoid 102 for a predetermined time, the claw portion 121*a* of the cam 121 is disengaged from the solenoid 102. Accordingly, the trigger lever 123 biases the biasing cam 122 in the direction indicated by the arrow D (FIG. 7) with the elasticity (bias) of the biasing spring 124. As a result, the cam 121 is rotated such that the gear portion 126*a* of the gear 126 is engaged with the drive gear 127, and thus the biasing cam 122, the cam 121, and the rotary 105 which are biased by the trigger lever 123 are integrally rotated in the direction indicated by the arrow D. Then, the gear portion 126*a* is engaged with the drive gear 127, and then is rotated to one of the subsequent toothless portion 126*b*. After that, the cam 121 is locked by the solenoid 102, so the biasing cam 122, the cam 121, and the rotary 105 are stopped. That is, each of the subsequent developing devices is moved by the rotary 105 to the development position so as to be stopped.

As described above, in Embodiment 3, the solenoid 102 (engaging member) is engaged with the claw portion (engaging portion) 121*a*, whereby the rotation of the cam 121 (rotation member) is stopped. With this construction, the drive transmission mechanism may come into a stop state in which transmission of a rotation force from the gear (driving member) 173 to the gear (second transmission gear member) 126 is stopped, and an operation state in which, according to the rotation of the cam 121, the gear 126 is rotated while receiving the transmission of the rotation force from the gear 173. Further, in the operation state, the rotary 105 is rotated by a predetermined amount to sequentially move the developing devices 18*a* to 18*d* to the development position 18Y.

Further, in Embodiment 3, the drive transmission mechanism has a rotation force transmission unit Z which may come into the stop state in which transmission of a rotation force from the motor M is stopped, and the operation state in which transmission of a rotation force from the motor M is performed. In the operation state, the rotation force transmission unit Z rotates, while receiving the rotation force from the motor M, the rotary 105 by a predetermined amount to sequentially move the developing devices 18*a* to 18*d* to the development position 18Y. Herein, the rotation force transmission unit Z includes the gear 127, the gear 126, and the cam 121, the cam 122, and the solenoid 102.

Even with the above-mentioned construction, the same effects can be obtained as those of Embodiments 1 and 2. That is, even without the driving motor which can be controlled in its rotating speed being independently provided therewith, the rotation of the rotary can be controlled.

Note that, in Embodiment 3, in order to sequentially move the four developing devices having respective colors, the four claw portions 121*a* to 121*d* and the four toothless portions 126*a* to 126*d* are provided at equal angles, respectively. However, it is only necessary for those members to be provided at 4×N portions (N is a natural number). Further, as described in Embodiments 1 and 2, it is only necessary for those members to be provided at 3×N portions (N is a natural number) in the case of three colors, and at 2×N portions (N is a natural number) in the case of two colors. The same holds true in the cases of five colors or more.

In Embodiments 1 to 3 described above, the solenoid 102 is controlled by the unit C.

Further, in Embodiments 1 to 3, the member for transmitting the rotation force is not limited to the gear. Examples of the gear member which can be appropriately used include a gear, a toothed belt, and a transmission belt which transmit the rotation force.

Still further, in Embodiments 1 to 3, the motor M continues to be rotated even in the stop state, whereby the control of the motor is simplified.

Yet further, in Embodiments 1 to 3, the rotation force from the motor M rotates not only the rotary 105, but also the member to which a rotation force is transmitted after transmission thereto. In this case, examples of the member to which a rotation force is transmitted include at least one of the conveyor rollers (registration rollers) 53 for conveying the sheets S, the fixing device 54 for fixing the developer image transferred onto the sheet S, and the transfer belt 7 for conveying the sheets S to the photosensitive drum 2 so as to transfer the developer image formed on the photosensitive drum 2 onto the sheet S.

Yet further, in the Embodiments, a printer is exemplified as an electrophotographic image forming apparatus. However, the present invention is not limited thereto. The present invention may be applicable to other electrophotographic image forming apparatus such as a copying machine and a facsimile machine, or a complex machine having the combined functions of those machines. Further, an image forming apparatus is exemplified, in which with the use of the intermediate transfer member (belt), the developer image of each color is sequentially superimposed on one another to be transferred onto the intermediate transfer member, and then the developer images held on the intermediate transfer member are collectively transferred onto the recording medium. However, the present invention is not limited thereto. The present invention may be applicable to an electrophotographic image forming apparatus in which, with the use of the recording medium carrying member, the developer image of each color is sequentially superimposed on one another to be transferred onto the recording medium carried on the recording medium carrying member. The same effects can be obtained by the application of the present invention to the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2007-128983, filed May 15, 2007, and No. 2008-112000, filed Apr. 23, 2008, which are hereby incorporated by reference herein in their entirety.

What is claimed is:

1. A color electrophotographic image forming apparatus for forming an image on a recording medium, the color electrophotographic image forming apparatus comprising:

an electrophotographic photosensitive member;

a rotatable supporting member which supports a number V of developing devices (where V is a natural number) for developing an electrostatic latent image formed on the electrophotographic photosensitive member;

an electric actuator;

a rotary member having a number M of engaging portions (where M is a natural number) engageable with the electric actuator; and a drive transmission mechanism including a transmission gear having a number X of teeth (where X is a natural number), to which a rotation force is transmitted from a driving member rotated in one direction, and a rotary rotatable supporting member gear having a number Y of teeth (where Y is a natural number), the rotatable supporting member gear engaged with the transmission gear so as to be integrally rotated with the rotary rotatable supporting member, each value of the natural numbers being set to satisfy a relation that (X/M) is an aliquot part of (Y/V), wherein each time one of the engaging portions is disengaged from the electric actuator, the rotary member makes a 1/M revolution, and once every 1/M revolution, a rotation force is transmitted from the transmission gear which is rotated integrally with the rotatable member to the rotatable supporting member gear, and the rotatable supporting member is stopped after being rotated by an angle W which is an aliquot part of (360°/V), to sequentially move each of the plurality of developing devices to a development position in which the electrostatic latent image is developed.

2. A color electrophotographic image forming apparatus according to claim 1, wherein the drive transmission mechanism includes:

a partially-toothless gear having a gear portion engageable with the driving member and the number M of toothless portions facing the driving member when the electric actuator is engaged with one of the engaging portions of the rotary member; and an elastic member which biases the rotary member in a rotational direction thereof, wherein when one of the engaging portions is disengaged from the electric actuator, the rotary member is rotated so that the gear portion of the partially-toothless gear is engaged with the driving member by an elastic force of the elastic member, and wherein when the electric actuator is engaged with one of the engaging portions, the rotation of the rotary member is stopped in a position in which one of the toothless portions of the partially-toothless gear faces the driving member.

* * * * *